United States Patent [19]

Renaud

[11] Patent Number: 5,031,722

[45] Date of Patent: Jul. 16, 1991

[54] EXTENDABLE SCAFFOLD BRACKET

[76] Inventor: Robert H. Renaud, 379 Birchwood Drive, St. Sauveur, Quebec, Canada, J0R 1R1

[21] Appl. No.: 599,750

[22] Filed: Oct. 19, 1990

[30] Foreign Application Priority Data

Oct. 19, 1989 [CA] Canada ..... 2001012

[51] Int. Cl.[5] ..... E06C 7/16; E06C 1/39

[52] U.S. Cl. ..... 182/117; 182/121

[58] Field of Search ..... 182/117, 121, 120; 248/238

[56] References Cited

U.S. PATENT DOCUMENTS

| | | | |
|---|---|---|---|
| 393,512 | 11/1888 | Long | 248/238 |
| 400,008 | 3/1889 | Rasor | 248/238 |
| 689,390 | 12/1901 | Ewing | 248/238 |
| 881,996 | 3/1908 | Block | 248/238 |
| 1,187,437 | 6/1916 | Lucas | 248/238 |
| 1,228,868 | 6/1917 | Anderson . | |
| 2,418,597 | 4/1947 | Neff . | |
| 2,936,989 | 5/1960 | Siek | 182/117 |
| 4,306,700 | 12/1981 | Bell . | |

*Primary Examiner*—Reinaldo P. Machado

[57] ABSTRACT

A scaffold bracket for mounting on a ladder. The bracket comprises at least two legs, which are connected at one end to define a junction, said legs divergingly extending from the junction to their free ends. A plurality of first rung engaging members are distributed along the legs from their free ends and terminate short of the junction. A link is attached at the junction and terminates in a second rung engaging member. The bracket is so constructed and arranged that the legs are placed over a selected rung of the ladder and are engaged thereon by engagement of a first rung engaging member, the second rung engaging member is engaged over an upper located rung, a second bracket is similarly mounted on a second ladder placed side by side relative to the first ladder, and a wood plank is placed on the two brackets to constitute a scaffold.

5 Claims, 1 Drawing Sheet

EXTENDABLE SCAFFOLD BRACKET

BACKGROUND OF INVENTION (a) Field of the Invention

This invention relates to a scaffold bracket. More particularly, the present invention relates to a scaffold bracket of the type to be mounted on a ladder and to be used in pairs along with a wood plank to constitute a scaffold.

(b) Description of Prior Art

The preparation of a scaffold to work on a residential, commercial or industrial building always presents a problem. If the scaffold is built from planks, this is time consuming and is expensive in terms of materials which cannot normally be reused for the same purpose. If, on the other hand, commercially available scaffolding is used, this is expensive, and is not always available, not to mention the fact that the one that could be obtained does not always fit the intended use.

Complicated designs are known such as those disclosed in the following U.S. Pat. Nos.:

1,228,868
2,418,597
4,306,700

However, because of the complicated mechanical structures of these devices and the fact that they would be expensive to produce, they are not readily available on the market and do not constitute articles that a handyman would normally acquire for occasional use.

SUMMARY OF INVENTION

It is an object of the present invention to have access to an easy to install lightweight scaffold by using two ladders and brackets and a plank of wood.

According to the invention there is provided a scaffold bracket for mounting on a ladder, the bracket comprising at least two legs, the legs connecting at one end to define a junction, divergingly extending from the junction to their free ends. A plurality of first rung engaging means are distributed along the legs from the free ends and terminate short of their one ends. Linking means are attached at the junction and terminate in a second rung engaging means. The bracket is so constructed and arranged that the legs are placed over a selected rung of the ladder and is engaged thereon by engagement of a first rung engaging means, the second rung engaging means being engaged over an upper located rung, a second bracket is similarly mounted on a second ladder placed side by side relative to the first ladder, and a wood plank is placed on the two brackets to constitute a scaffold.

According to a preferred embodiment, the junction consists of an elongated member which extends from a point where the one ends meet, the linking means being attached at the free end of the elongated member.

According to another preferred embodiment, the linking means consists of a chain link, the second rung engaging means consists of a steel hook provided at the free end of the chain link, enabling to circle the upper located rung with the chain link and secure same thereover with the hook.

According to another preferred embodiment, the first rung engaging means may comprise a plurality of downwardly projecting prongs which enable the selected rung to fit between adjacent corresponding prong of each leg.

According to another preferred embodiment, there is provided a transverse member connecting the legs between the junction and the free ends.

BRIEF DESCRIPTION OF DRAWINGS

The invention will now be illustrated by means of the annexed drawings, which are only given for the purpose of illustration and in which.

DESCRIPTION OF PREFERRED EMBODIMENTS

Figure 1:
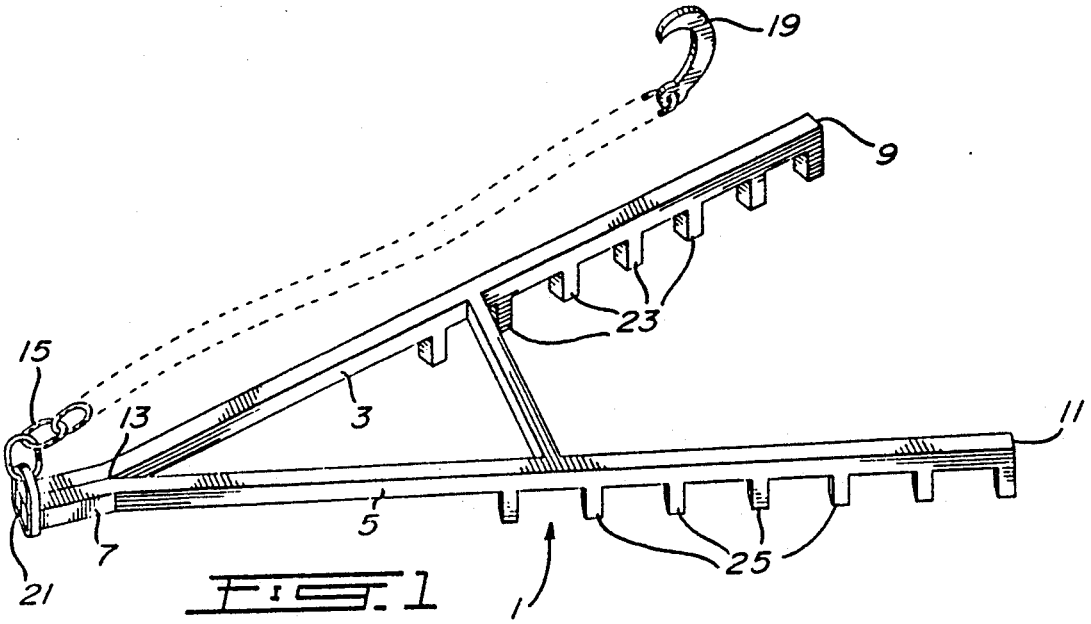
FIG. 1 is a perspective view of a scaffold bracket according to the invention.
Figure 2:
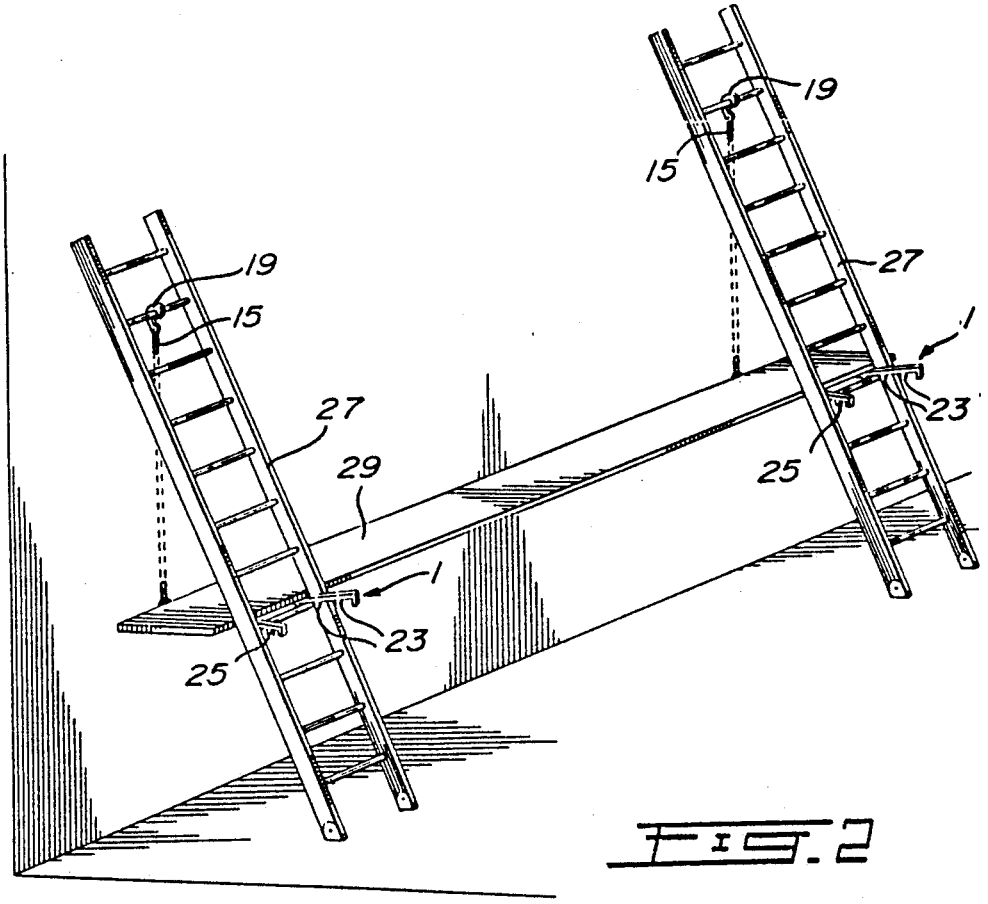
FIG. 2 is a sketch of the scaffold bracket according to FIG. 1 applied to a ladder.

Referring to the drawings, it will be seen that the scaffold bracket 1 which is illustrated comprises two legs 3 and 5 which are connected at one end to define a junction 7. As shown, the legs 3 and 5 extend by diverging from one another to the free ends 9 and 11 of respective legs 3 and 5. The junction 7, as shown, consists of an elongated member which extends from a point 13 where the diverging legs meet for a certain distance as shown in the drawings.

The bracket is associated with a chain link 15 having a yoke 17 at one end and a hook 19 at the opposite end. The chain link 15 is attached at the end 21 of the elongated member by means of the yoke 17 all in the manner as shown in the drawings.

A plurality of downwardly projecting prongs 23 and 25 are provided respectively for legs 3 and 5. The number can vary at will. In the embodiment illustrated there are seven prongs for each leg, it being understood that this number is not critical.

In operation, it is merely necessary to place a bracket with the prong section over a rung of the ladder 27, it being understood that the space between an two adjacent prongs will be selected depending on circumstances. The chain link 15 is then drawn to an appropriate upper rung, then the chain link 15 is allowed to circle an upper rung and securing is done through the hook 19. After having similarly mounted a second bracket on a second ladder placed side by side relative to the ladder 27, a wood plank 29 is placed on the two brackets to constitute a scaffold.

I claim:

1. A scaffold bracket for mounting on a ladder, said bracket comprising at least two legs, said legs connecting at one end to define a junction, said legs divergingly extending from said junction to free ends thereof, a plurality of first rung engaging means distributed along said legs from said free ends and terminating short of said one ends, linking means attached at said junction and terminating in a second rung engaging means, so constructed and arranged that said legs are placed over a selected rung of said ladder and are engaged thereon by engagement of a first rung engaging means, said second rung engaging means being engaged over an upper located rung, a second bracket is similarly mounted on a second ladder placed side by side relative to the first ladder, and a wood plank is placed on the two brackets to constitute a scaffold.

2. A scaffold bracket according to claim 1, wherein said junction consists of an elongated member which extends from a point where said one ends meet, said linking means being attached at the free end of said elongated member.

3. A scaffold bracket according to claim 2, wherein said linking means consists of a chain link, said second rung engaging means consists of a steel hook provided at the free end of said chain link, enabling to circle said upper located rung with said chain link and secure same thereover with said hook.

4. A scaffold bracket according to claim 3, wherein said first rung engaging means comprises a plurality of downwardly projecting prongs which enable said selected rung to fit between adjacent corresponding prongs of each leg.

5. A scaffold bracket according to claim 3, which comprises a transverse member connecting said legs between said junction and said free ends.

* * * * *